US009099220B2

(12) United States Patent
Gareis

(10) Patent No.: US 9,099,220 B2
(45) **Date of Patent: *Aug. 4, 2015**

(54) FLAT TYPE CABLE FOR HIGH FREQUENCY APPLICATIONS

(71) Applicant: BELDEN INC., St. Louis, MO (US)

(72) Inventor: Galen Mark Gareis, Oxford, OH (US)

(73) Assignee: BELDEN INC., St. Louis, MO (US)

( * ) Notice: Subject to any disclaimer, the term of this patent is extended or adjusted under 35 U.S.C. 154(b) by 248 days.

This patent is subject to a terminal disclaimer.

(21) Appl. No.: 13/855,243

(22) Filed: Apr. 2, 2013

(65) Prior Publication Data

US 2013/0220664 A1 Aug. 29, 2013

Related U.S. Application Data

(63) Continuation of application No. 12/870,628, filed on Aug. 27, 2010, now Pat. No. 8,431,825.

(51) Int. Cl.
*H01B 11/04* (2006.01)
*H01B 7/08* (2006.01)

(52) U.S. Cl.
CPC ..... *H01B 7/0876* (2013.01); *H01B 7/0823* (2013.01); *H01B 11/04* (2013.01)

(58) Field of Classification Search
CPC ..... H01B 7/08; H01B 11/04
USPC ..... 174/113 R, 117 F
See application file for complete search history.

(56) References Cited

U.S. PATENT DOCUMENTS

| | | | | |
|---|---|---|---|---|
| 4,034,148 | A | | 7/1977 | Lang |
| 4,454,378 | A | | 6/1984 | Neuroth |
| 4,467,138 | A | | 8/1984 | Brorein |
| 4,486,619 | A | | 12/1984 | Trine et al. |
| 4,487,992 | A | | 12/1984 | Tomita |
| RE32,225 | E | | 8/1986 | Neuroth |
| 4,767,891 | A | | 8/1988 | Biegon et al. |
| 4,777,325 | A | | 10/1988 | Siwinski |
| 4,800,236 | A | | 1/1989 | Lemke |
| 4,801,764 | A | | 1/1989 | Ohlhaber |
| 4,873,393 | A | * | 10/1989 | Friesen et al. ..... 174/34 |
| 5,180,890 | A | | 1/1993 | Pendergrass et al. |
| 5,220,130 | A | | 6/1993 | Walters |
| 5,245,134 | A | | 9/1993 | Vana, Jr. et al. |
| 5,268,531 | A | | 12/1993 | Nguyen et al. |
| 5,276,759 | A | | 1/1994 | Nguyen et al. |
| 5,298,680 | A | | 3/1994 | Kenny |
| 5,342,991 | A | | 8/1994 | Xu et al. |
| 5,399,813 | A | | 3/1995 | McNeill et al. |
| 5,486,654 | A | | 1/1996 | Hanak et al. |
| 5,544,270 | A | | 8/1996 | Clark et al. |

(Continued)

FOREIGN PATENT DOCUMENTS

JP 05-290645 11/1993

*Primary Examiner* — Chau N Nguyen
(74) *Attorney, Agent, or Firm* — Lando & Anastasi, LLP

(57) ABSTRACT

A flat-type cable suitable for use in high frequency communications. The cable has a plurality of longitudinally extending and substantially parallel passageways, each housing a twisted pair conductor. The twisted pair conductors are disposed in the cable in a manner that the twisted pair conductors with the longest lay lengths are disposed in the passageways closest to the edges of the cable, and the passageways farther away from the edges of the cable house twisted pair conductors with progressively shorter lay lengths.

19 Claims, 9 Drawing Sheets

(56) References Cited

U.S. PATENT DOCUMENTS

| | | | | |
|---|---|---|---|---|
| 5,763,823 | A | 6/1998 | Siekierka et al. | |
| 5,770,820 | A | 6/1998 | Nelson et al. | |
| 5,821,466 | A | 10/1998 | Clark et al. | |
| 5,821,467 | A | 10/1998 | O'Brien et al. | |
| 5,834,697 | A | 11/1998 | Baker et al. | |
| 5,883,334 | A | 3/1999 | Newmoyer et al. | |
| 5,939,668 | A * | 8/1999 | De Win | 174/36 |
| 6,153,826 | A | 11/2000 | Kenny et al. | |
| 6,162,992 | A | 12/2000 | Clark et al. | |
| RE37,010 | E | 1/2001 | Newmoyer | |
| 6,248,954 | B1 | 6/2001 | Clark et al. | |
| 6,254,924 | B1 | 7/2001 | Brorein et al. | |
| 6,255,593 | B1 | 7/2001 | Reede | |
| 6,300,573 | B1 | 10/2001 | Horie et al. | |
| 6,303,867 | B1 | 10/2001 | Clark et al. | |
| 6,452,094 | B2 | 9/2002 | Donner et al. | |
| 6,566,607 | B1 | 5/2003 | Walling | |
| 6,812,408 | B2 | 11/2004 | Clark et al. | |
| 6,875,928 | B1 | 4/2005 | Hayes et al. | |
| 6,998,537 | B2 | 2/2006 | Clark et al. | |
| 7,015,397 | B2 | 3/2006 | Clark | |
| 7,053,310 | B2 | 5/2006 | Clark | |
| 7,179,999 | B2 | 2/2007 | Clark et al. | |
| 7,332,676 | B2 * | 2/2008 | Sparrowhawk | 174/102 R |
| 7,358,436 | B2 | 4/2008 | Dellagala et al. | |
| 7,405,360 | B2 | 7/2008 | Clark et al. | |
| 7,449,638 | B2 | 11/2008 | Clark et al. | |
| 7,534,964 | B2 | 5/2009 | Clark et al. | |
| 8,431,825 | B2 * | 4/2013 | Gareis | 174/113 R |

* cited by examiner

FLAT TYPE CABLE FOR HIGH FREQUENCY APPLICATIONS

CROSS-REFERENCE TO RELATED APPLICATIONS

This application is a continuation of, and claims priority under 35 U.S.C. §120 to, co-pending U.S. application Ser. No. 12/870,628 entitled "FLAT TYPE CABLE FOR HIGH FREQUENCY APPLICATIONS," filed Aug. 27, 2010, and which is herein incorporated by reference in its entirety.

BACKGROUND OF THE INVENTION

1. Field of the Invention

The present invention relates to a flat type cable and, more particularly to a flat type cable suitable for use in high frequency applications.

2. Description of Related Art

Twisted pair cables are widely used as high-speed data communications media. One common type of conventional cable for high-speed data transmission includes four twisted pairs that may be bundled and twisted (cabled) together and further covered with a jacket to form the cable. Typically, two of the twisted pairs may transmit data and the other two of pairs may receive data.

A transmission cable utilizing above described twisted pair technology must meet particular specifications with respect to certain electrical characteristics for transmission at high frequencies. The electrical characteristics include controlled impedance, controlled near-end cross-talk (NEXT), controlled equated level far end cross talk (ELFEXT), controlled attenuation, and so on. These specification requirements may become more stringent for performance at higher frequencies. The Telecommunications Industry Association and the Electronics Industry Association (TIA/EIA) has developed standards providing such specifications for high performance transmission cables. The International Electrotechnical Commission (IEC) has also defined standards for the same. TIA's Category 6 cable, commonly referred to as Cat-6, is a cable standard that provides specifications for performance up to 250 MHz and is suitable for networks like 10 BASE-T, 100 BASE-TX (Fast Ethernet), 1000 BASE-T/1000 BASE-TX (Gigabit Ethernet), and specifications for performance up to 500 MHz for mitigated 10 GBASE-T (10-Gigabit Ethernet). Compared with Cat-5 and Cat-5e cable standards, Cat-6 features more stringent specifications for crosstalk and system noise. Similarly, the Cat-7 cable standard which is defined for frequencies up to 1000 MHz features more stringent specifications for crosstalk and system noise compared to Cat-6.

For better crosstalk performance, in general, twisted pair conductors of different lay lengths are used inside a transmission cable. In ordinary transmission cables which have a round cross section, twisted pairs are arranged in an alternate Long, Short, Long, Short (LSLS) lay configuration. In other words, the twisted pairs of long lay length and short lay length are arranged alternately within the circumference of the circular cross section of the cable in a substantially circular arrangement. However, cables with a round cross section have a greater number of possible crosstalk combinations vis-a-vis a flat type cable. In a flat type cable, the multiple twisted pairs are laid out in a substantially flat arrangement, for example in a coplanar or crescent shaped arrangement, inside the jacket.

In addition to having fewer closely spaced possibly troublesome crosstalk combinations, which is combinations that at the operating frequencies experience enough crosstalk to affect the performance of the cable, flat type cables have other favorable properties. For example, flat type cables have a smaller bend radius across the minor cable axis, and have the ability to roll up compactly. Flat type cables are also preferred due to the elimination of the overall strand operation requirement in cable layout. Some implementations of such flat type cables are described in U.S. Pat. No. 5,821,467. Known flat type cables such as Belden's MediaTwist™ also use a LSLS lay configuration, that is, they have an alternate arrangement or long lay and short lay twisted pair conductors. However, using the LSLS configuration in flat cables has one or more disadvantages.

First, in this configuration, one of the edge twisted pairs is a short lay pair. Short lay twisted pair conductors typically experience greater attenuation than long lay twisted pair conductors. In addition, the edge twisted pair conductors in a flat cable suffer more attenuation compared to central ones as the edge pairs are surrounded by more jacket material.

Owing to the aforementioned factors, the short lay twisted pair conductor on the cable's edge experiences more attenuation than the other twisted pair conductors in the cable, and becomes the cable's physical and electrical performance bottleneck. Second, one of the central twisted pairs is a long lay pair. Long lay twisted pair conductors typically show poorer crosstalk performance than the short lay pairs. Further, the central twisted pair has two close physical proximity crosstalk combinations, as against a single close physical proximity crosstalk combination of an edge pair. These factors, in combination, lead to suboptimal attenuation and crosstalk performance of flat cables using the LSLS configuration, particularly at higher frequencies.

SUMMARY OF THE INVENTION

Due to these and other problems in the art, disclosed herein, among other things, is a flat type cable capable of transmitting data at high frequencies. According to one embodiment of the present invention the cable comprises a plurality of longitudinally extending and substantially parallel passageways and a plurality of twisted pair conductors, each twisted pair conductor disposed in one of said passageways, wherein at least one of the twisted pair conductors has a lay length different from another of the twisted pair conductor, and wherein the twisted pair conductors which are disposed in the passageways located nearer to the edges of the cable, have a lay length greater than or equal to the twisted pair conductors which are disposed in the passageways located farther from the edges of the cable.

According to an embodiment, the cable comprises four longitudinally extending and substantially parallel passageways, each housing a twisted pair conductor, wherein two of the twisted pair conductors are of longer lay length than the remaining two twisted pair conductors, and the two longer lay twisted pair conductors are disposed in the two outermost passageways.

In an embodiment there is described herein, a flat-type cable comprising: a flat-type jacket comprising at least three longitudinally extending and substantially parallel passageways not arranged about an axis located between them; and at least three twisted pair conductors, each of said twisted pair conductors being disposed inside one of the passageways, wherein at least one of the twisted pair conductors has a lay length different from another of the twisted pair conductors, and the twisted pair conductors which are disposed in the passageways located nearer to the edges of the jacket, have a lay length greater than or equal to the twisted pair conductors which are disposed in the passageways located farther from the edges of the cable.

In an embodiment, the cable has at least four twisted pair conductors.

In an embodiment, the cable is crescent shaped.

In an embodiment, the cable is flat.

In an embodiment, at least one of the twisted pair conductors is shielded.

In an embodiment, each of the twisted pair conductors is unshielded.

In an embodiment, the twisted pair conductors are collectively shielded by a common overall shield.

In an embodiment, the twisted pair conductors are bonded together.

In an embodiment, each of the twisted pair conductors has a lay length ranging from about 0.300 inches to about 1.5 inches.

In an embodiment, each of twisted pair conductors has two insulated conductors and each insulated conductor has AWG of 18-40.

In an embodiment, the twisted pair conductors have any combination or clockwise or counterclockwise twinning lay rotations.

In an embodiment, the jacket is made of a material comprising a foamed polymer.

In an embodiment, the jacket is made of a material comprising one or more of polyvinyl chloride, fluorinated ethylene propylene (FEP), and high-density polyethylene.

There is also described herein, in an embodiment, a flat-type cable comprising: a set of four longitudinally extending and substantially parallel passageways not arranged about an axis located between them; a set of four twisted pair conductors, each disposed in one of the passageways; wherein two of the twisted pair conductors are of longer lay length than the remaining two of the twisted pair conductors, and the two twisted pair conductors of longer lay length are disposed in the two passageways of the cable which are the furthest from each other.

In an embodiment, the cable is crescent shaped.

In an embodiment, the cable is flat.

In an embodiment, the twisted pair conductors have a lay length ranging from about 0.300 inches to about 1.5 inches.

In an embodiment, each twisted pair conductor has two insulated conductors and each insulated conductor has an AWG of 18-40.

In an embodiment, at least one of the twisted pair conductors has a clockwise lay rotation.

There is also described herein, in an embodiment, a crescent shaped signal transmission cable comprising: a flat type jacket comprising four longitudinally extending and substantially parallel passageways not arranged about an axis located between them, wherein two of said passageways are closer to an edge of said cable than the other two of said passageways, said passageways closer to said edges comprising edge passageways and the other two passageways comprising middle passageways; and a set of four twisted pair conductors, each twisted pair conductor disposed in one of said passageways, wherein two of said twisted pair conductors have a long lay length and are disposed in said edge passageways, and wherein the remaining two twisted pair conductors have a short lay length and are disposed in said middle passageways.

The present invention and advantages thereof will become more apparent upon consideration of the following detailed description when taken in conjunction with the accompanying drawings.

DESCRIPTION OF THE PREFERRED EMBODIMENT(S)

Figure 1:
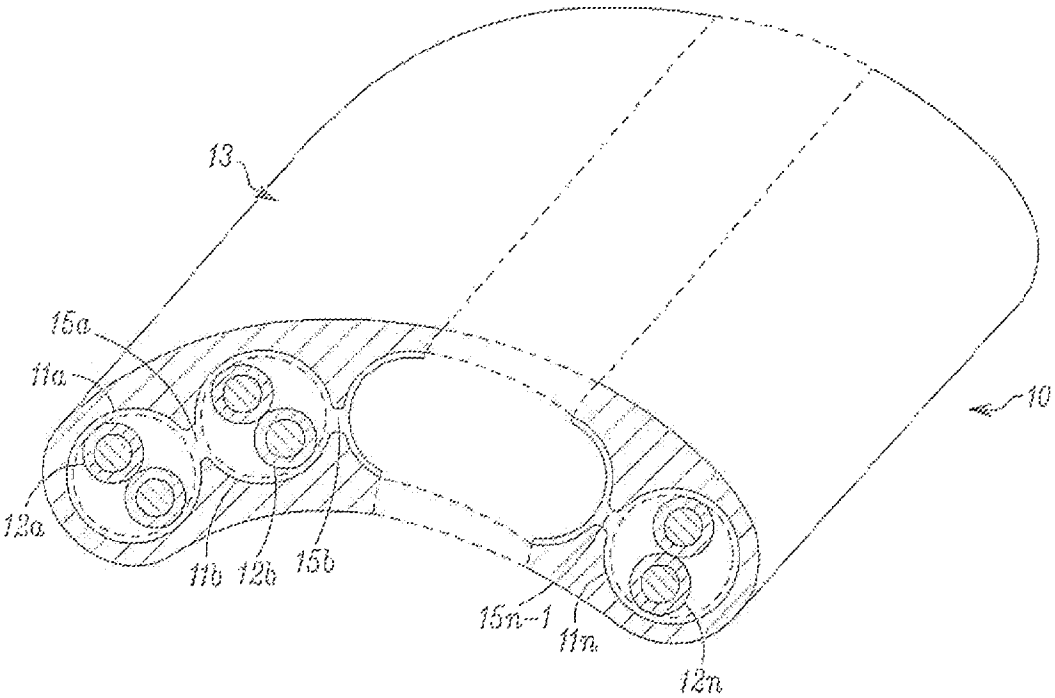
FIG. 1 is a side perspective view of the flat type cable according to one embodiment of the present invention.

Aspects and embodiments of the invention are directed to a flat-type cable that may exhibit superior transmission properties at high frequencies through the use of arrangement of twisted pair conductors which extends crosstalk frequencies and improves signal attenuation in the twisted pairs. The cable is generally used for digital or analog communication cables having frequencies from about 1.0 to 635 MHz and higher.

In alternative embodiments, the cable designs can allow for shorter lay lengths to be used in flat type cables without necessarily causing losses from attenuation. The use of such shorter lay lengths in all of the component twisted pairs can provide for a cable with improved flex while still allowing it to meet more rigorous requirements such as those necessary for Cat-6 or Cat-7.

Various illustrative embodiments and aspects thereof are described in detail below with reference to the accompanying figures. It is to be appreciated that this invention is not limited in its application to the details of construction and the arrangement of components set forth in the following description or illustrated in the drawings. The invention is capable of other embodiments and of being practiced or of being carried out in various ways. Examples of specific implementations are provided herein for illustrative purposes only and are not intended to be limiting. In particular, acts, elements and features discussed in connection with one embodiment are not intended to be excluded from a similar role in other embodiments.

Also, the phraseology and terminology used herein is for the purpose of description and should not be regarded as limiting. The use of "comprising," "having," "containing," and variations thereof herein, is meant to encompass the items listed thereafter and equivalents thereof as well as additional items.

Various embodiments of the present invention provide a flat type cable with improved attenuation and crosstalk performance, suitable for use in high frequency applications. The frequency at which the cable operates may vary from 1 MHz to 635 MHz or higher. FIG. 1 shows a flat type cable 10, according to one embodiment of the present invention. The cable 10 houses a generic number of twisted pair conductors, denoted herein as n twisted pair conductors. Many conventionally used data communication cables house four twisted pairs (n=4). However, the principles and teachings of the present invention find application in all substantially flat type cables, housing any number of twisted pairs without limitation. The flat type cable 10 has a plurality of longitudinally extending passageways 11*a*, 11*b* . . . 11*n* (hereinafter "passageways 11*a*-11*n*") to house twisted pair conductors 12*a*, 12*b* . . . 12*n* (hereinafter "twisted pair conductors 12*a*-12*n*") as shown in the FIG. 1.

The cable 10 includes a jacket 13 formed of a suitable jacket material conventionally utilized in making such cables. For example, the jacket material may be, but is not limited to, foamed or non-foamed polyvinyl chloride, fluorinated polymers, polyethylene, flame retardant compositions, and the like. In an embodiment of the present invention, the jacket 13 is a flat-type jacket. The flat-type jacket may be completely flat, or may have a crescent shaped cross-section as discussed below.

The interior of the jacket 13 is divided into longitudinally extending passageways 11*a*-11*n* that extend through the entire length of the cable 10. In an embodiment, each passageway may open into an adjacent passageway by longitudinally extending openings 15*a*, 15*b* . . . 15*n*-1. In another embodiment, the longitudinally extending passageways 11*a*-11*n* may be isolated without being connected though any openings. Further, the cross-section of passageways 11*a*-11*n* may be of any desired shape including, without limitation, circular, elliptical, rectangular, polygonal, and so on. Generally, in the event that the jacket 13 is intended to be flat, the passageways will be arranged so as to be generally coplanar.

When the jacket 13 is referred to herein as "crescent shaped," such as that shown in FIG. 1, the jacket 13 is generally not a true mathematical crescent (although it may be) but instead will generally be in the form of an arc, such as shown in FIG. 1. In such arrangement the passageways are not arranged around a center axis which is enclosed by them (as would be the case in a circular cable), but are instead arranged to have generally similar radius from an axis arranged toward and away from one side of the jacket 13.

The twisted pair conductors 12*a*-12*n* may be disposed within the passageways 11*a*-11*n*. For example, the twisted pair conductor 12*a* is disposed in the passageway 11*a*, the twisted pair conductor 12*b* is disposed in the passageway 11*b*, and so on. In various embodiments, the twisted pair conductors 12*a*-12*n* have different lay lengths. In an embodiment, the twisted pair conductors disposed in the passageways at the edges (that is the twisted pairs which are the furthest from each other) of the cable 10 have a longer lay length than the twisted pair conductors disposed in the passageways farther from the edges of the cable 10. In other words, the lay lengths of the twisted pair conductors 12*a*-12*n* decrease from the edges of the cable 10 towards its centre. Thus, the twisted pair conductors 12*a* and 12*n* are of longer or equal, but not shorter, lay length than the twisted pair conductors 12*b* and 12*n*-1 (not shown). Similarly, the twisted pair conductors 12*b* and 12*n*-1 (not shown) are of longer or equal lay length than the twisted pair conductors 12*c*, 12*d* . . . 12*n*-2 (not shown). It should be noted that the conductors 12*a* and 12*n* will generally not have the same lay length, but will instead each have a greater lay length than either of the conductors 12*b* and 12*n*-1.

According to various embodiments of the present invention, the twisted pair conductors 12*a*-12*n* may have a lay length ranging from about 0.300 inches to about 1.5 inches. Using such a configuration of decreasing lay length of the twisted pair conductors 12*a*-12*n* from the edges of the cable 10 towards the centre of the cable 10 generally improves the electrical performance of the cable 10 at higher frequencies. The attenuation performance of the cable improves since the shorter lay sets, which suffer more attenuation compared to the longer lay sets, are in the central passageways of the cable. In the central passageways, the lay sets are surrounded with less jacket material, which results in less attenuation. The cross talk performance improves because the longer lay sets are placed farther from each other. Longer lay sets in general suffer from greater crosstalk than the shorter lay sets. Therefore, placing the longer lay sets at the edges, where they have fewer possible close proximity crosstalk combinations, generally improves the crosstalk performance of the cable.

The twisted pair conductors 12*a*-12*n* may have different or same lay orientations. According to various embodiment of the present invention, the twisted pair conductors 12*a*-12*n* have lay rotation in the same direction. In an embodiment, the twisted pair conductors 12*a*-12*n* have clockwise lay rotation. According to another embodiment of the present invention, the twisted pair conductors 12*a*-12*n* have counterclockwise lay rotation. According to other embodiments of the present invention, some of the twisted pair conductors 12*a*-12*n* have clockwise lay rotation and others have anticlockwise lay rotation.

Figure 2:
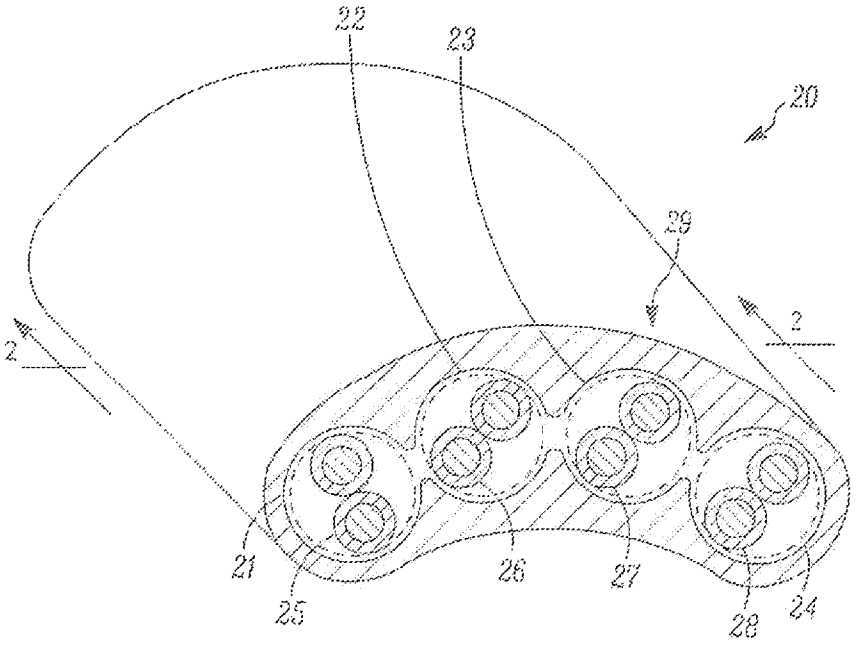
FIG. 2 is a side perspective view of the flat type cable according to a preferred embodiment of the present invention.

Referring to FIG. 2, there is shown a flat type cable 20, according to an embodiment of the present invention. FIG. 2 illustrates a side perspective view of the cable 20. The construction of the cable 20 is similar to the cable 10, with the distinction that cable 20 has four longitudinally extending passageways 21, 22, 23, and 24 (hereinafter "passageways 21-24") as shown in the figure. Each of the passageways 21-24 houses one of four twisted pair conductors 25, 26, 27, and 28 (hereinafter "twisted pair conductors 25-28"). The four twisted pair conductors 25, 26, 27, and 28 are arranged in the cable 20 as shown, with the first twisted-pair conductor 25 being on one edge of the cable 20 and the fourth twisted pair conductor 28 being on the opposite edge of the cable 20. The cable 20 is covered by a jacket 29. The jacket 29 may have a convex upper surface and a concave lower surface. The jacket 29 may be prepared from a suitable foamed or unfoamed polymer such as polyvinyl chloride, which may be, for example, partially foamed with 10%-15% voids.

According to various embodiments of the present invention, the twisted pair conductors 25, 26, 27, and 28 are of two different types—long lay length and short lay length. The twisted pair conductors of long lay length are disposed in the outer passageways 21 and 24, and the twisted pair conductors of short lay length are disposed in the central passageways 22 and 23. Such an arrangement of twisted pair conductors will be referred to as Long, Short, Short, Long (LSSL) configuration herein.

According to various embodiments of the present invention, the lay lengths of twisted pair conductors 25, 26, 27 and 28 range from about 0.300 inches to about 1.5 inches. In an example embodiment of the present invention, the twisted pair conductor 25 has a lay length of 0.541 inches, the twisted pair conductor 26 has a lay length of 0.399 inches, the twisted pair conductor 27 has a lay length of 0.447 inches and the twisted pair conductor 28 has a lay length of 0.615 inches. According to some embodiments of the present invention, the twisted pair conductors 25 and 28 have equal lay lengths and the twisted pair conductors 26 and 27 have equal lay lengths. According to various other embodiments of the present invention, the edge twisted pair conductors 25 and 28 have a substantially similar but not identical lay length and the central twisted pair conductors 26 and 27 have a substantially similar but not identical lay length.

To put this another way, the conductors may be arranged from longest to shortest by referring to the reference numbers in FIG. 2 as 24-25-26-27, 25-24-26-27, 25-24-27-26, or 24-25-27-26.

Another way to think of this is that the outermost twisted pairs, that is those arranged towards the edge of the cable or furthest from each other, again referring to FIG. 2 have the longest lay (25 or 24), and the shortest long lay (25 or 24), while the two intermediate cables (or the cables which are spaced from the edges of the cable) have the shortest lay (26 or 27) and the longest short lay (26 or 27). Thus, when this disclosure refers to the cable having an LSSL (or long-short-short-long) arrangement, the cables indicated as being long are simply longer than whose which are indicated to be short, there is no requirement as to the relationship within twisted pairs indicated to be long nor within those indicated to be short.

The use of the LSSL configuration is believed to improve the attenuation and/or crosstalk performance of the cable 20 at higher frequencies as compared to the conventionally used Long, Short, Long, Short (LSLS) configuration. The specific improvement of the cable versus a conventional arrangement will often relate to whether the LSSL configuration utilizes twisted pairs having overall reduced lay lengths compared to the LSLS arrangement, utilizes overall increased lay length compared to the LSLS arrangement, or uses the same lay lengths as the LSLS arrangement to which it is being compared. The attenuation and/or the crosstalk performances of the cable 20 using the LSSL configuration may improve both for bonded or unbonded cables and for shield and unshielded cables. In alternative embodiments, the cable flex may be increased, or other features of the cable can be altered, while maintaining similar crosstalk and/or attenuation.

Generally, the LSSL configuration need not increase the overall cost of production of the cable 20. On the contrary, the cable 20 exhibits extended frequency range electrical characteristics compared to a LSLS configuration cable with equal to or shorter lay sets. Therefore, the use of the LSSL configuration allows the use of relatively longer lay sets, vis-a-vis the LSLS configuration, to achieve comparable electrical performance. This use of relatively longer lay sets offers advantages such as reduced material consumption and improved NEXT range.

According to various embodiments of the present invention, the cable 20 is of crescent shape. The jacket and its crescent shape enhance the flexibility of the cable and preserve twisted pair location. This shape generally causes the cable to curl towards its minor axis when a bending force is applied to the cable. This effect increases the bend radius at least two fold when compared to cables of typical flat design since the minor axis is less than half that of comparable designs. Additionally, this curling effect takes stress off the pairs themselves, reducing the possibility of pair crossover as seen with conventional flat configuration designs. According to some embodiments of the present invention, the jacket has a generally uniform thickness. However, varying jacket thickness may provide further advantages. The curl effect gained by the crescent shape is further enhanced by increasing the jacket thickness in the center portions of the cable 20. With the increased center thickness, the jacket is able to hold its shape. Accordingly, due to the shape of the cable, in some embodiments of the present invention, each of the passageways 25, 26, 27 and 28 may have walls with varying thickness.

According to various embodiments of the present invention, at least one of the twisted-pair conductors has non-fluorinated polymer insulation. It is preferred that the passageways containing the twisted pair conductor with the non-fluorinated polymer insulation have the greatest wall thickness. The greater wall thickness acts as a flame suppressant. Therefore in the embodiment shown in FIGS. 2 and 3, the non-fluorinated twisted pair conductors would be either or both of twisted pair conductors 26 and 27 in passageways 22 and 23 respectively. The present construction of the cable allows the use of twisted-pair conductors having cellular insulation. Longer lay lengths can be used with the twisted pair conductors to greatly reduce the compression forces encountered with tightly twisted—i.e., short lay lengths. This allows the benefit of thin wall foam dielectrics which improve attenuation while reducing material usage. Additionally, reduction in insulation usage through foaming allows for more types of materials to be utilized while maintaining flame and electrical characteristics. Further, foaming reduces overall size of insulated singles, which is advantageous with respect to fitting in standard industry connectors and to realizing a truly flexible construction.

Figure 3:
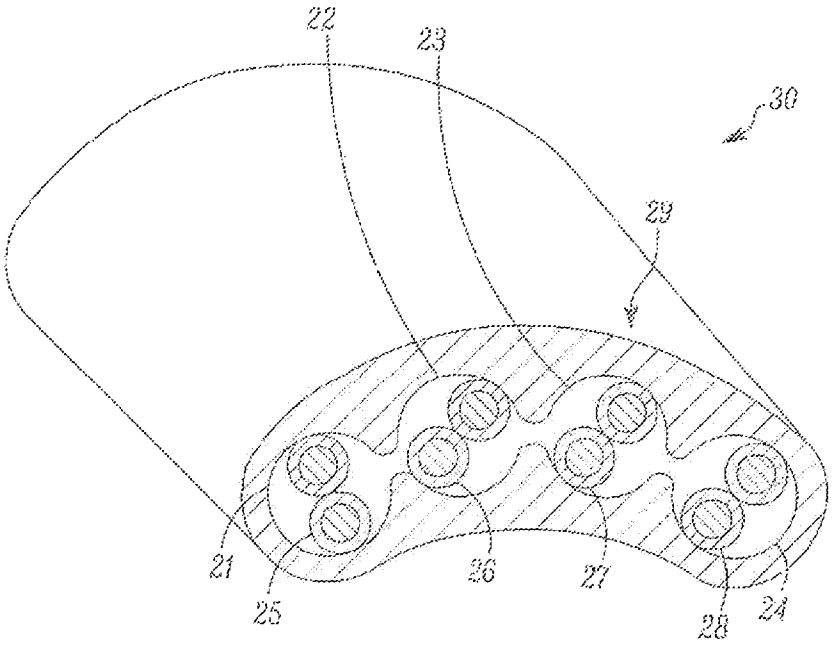
FIG. 3 is a side perspective view of one exemplary embodiment of the flat type cable shown in FIG. 2.

FIG. 3 illustrates a cable 30 utilizing the LSSL configuration, according to one embodiment of the present invention. The cable 30 represents the unshielded version of the flat type cable in which the twisted pair conductors 25-28 are arranged in LSSL configuration.

Figure 4:
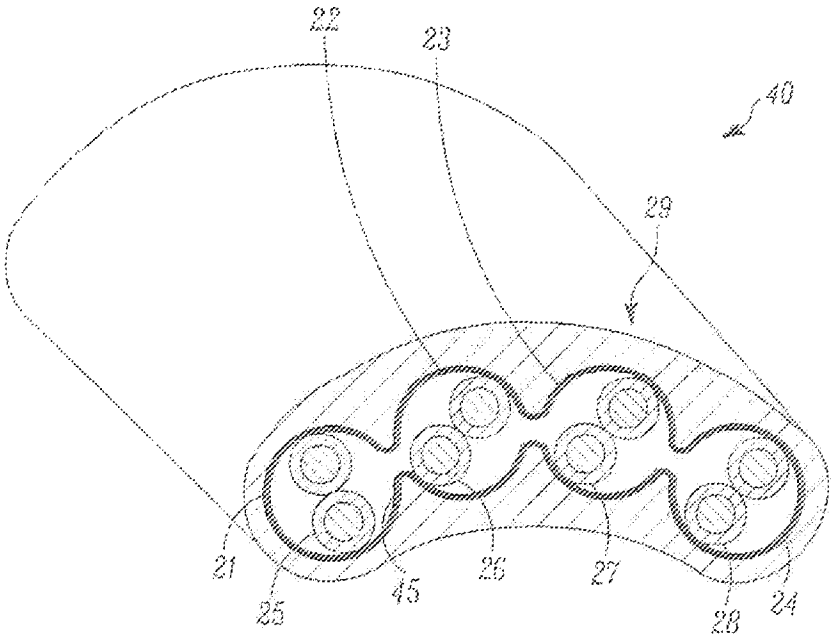
FIG. 4 is a side perspective view of another exemplary embodiment of the flat type cable shown in FIG. 2.

FIG. 4 illustrates a cable 40 utilizing the LSSL configuration, according to one embodiment of the present invention. The twisted pair conductors 25-28 are individually unshielded but collectively shielded by common shield 45. The common shield 45 may be in form of, but is not limited to, a metal braid or a metal foil. The metal used in the shield may be, but is not limited to, aluminum, copper, copper alloy, bronze (a copper alloy in which the alloying element is other than nickel or zinc, i.e., copper-cadmium alloy), silver, and the like. The outer metal shield 45 may be in the form of, but is not limited to, discontinuous foil polyester backed or continuous foil polyester backed tape shield. The outer metal shield 45 may help in improving the alien crosstalk (ANEXT) performance of the cable 20.

Figure 5:
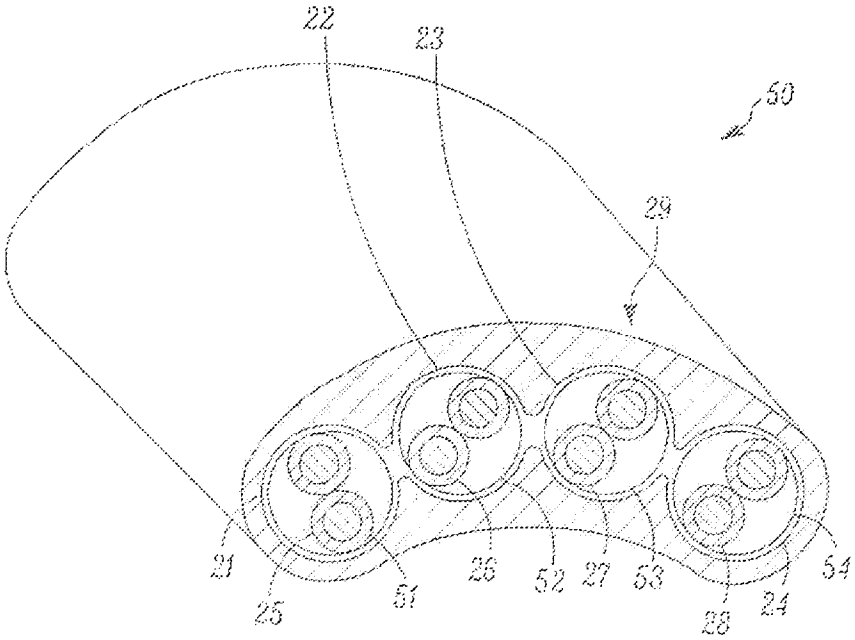
FIG. 5 is a side perspective view of yet another exemplary embodiment of the flat type cable shown in FIG. 2.

FIG. 5 illustrates a cable 50 utilizing the LSSL configuration, according to one embodiment of the present invention. The twisted pair conductors 25-28 are individually shielded by shields 51, 52, 53 and 54 (hereinafter "shields 51-54"). The shields 51-54 may be of any appropriate material such as, but not limited to, a metal tape or a composite tape with a non-metal base such as polyester (e.g. MYLAR) having a metal normally used in cable shields on one or both sides of the non-metal base. The metal for the tape and the composite tape may include, but is not limited to, aluminum, copper, copper alloy, nickel, silver, and the like. The shield 51 may be of the short fold BELDFOIL type tapes (this is a shield in which metal foil or coating is applied to one side of a supporting plastic film), or of the DUOFOIL type tapes (this is a shield in which the metallic foil or coating is applied to both sides of a supporting plastic film). In an example embodiment of the present invention, a 0.00035 inch foil layer is used on a 0.001 inch poly layer tape.

Figure 6:
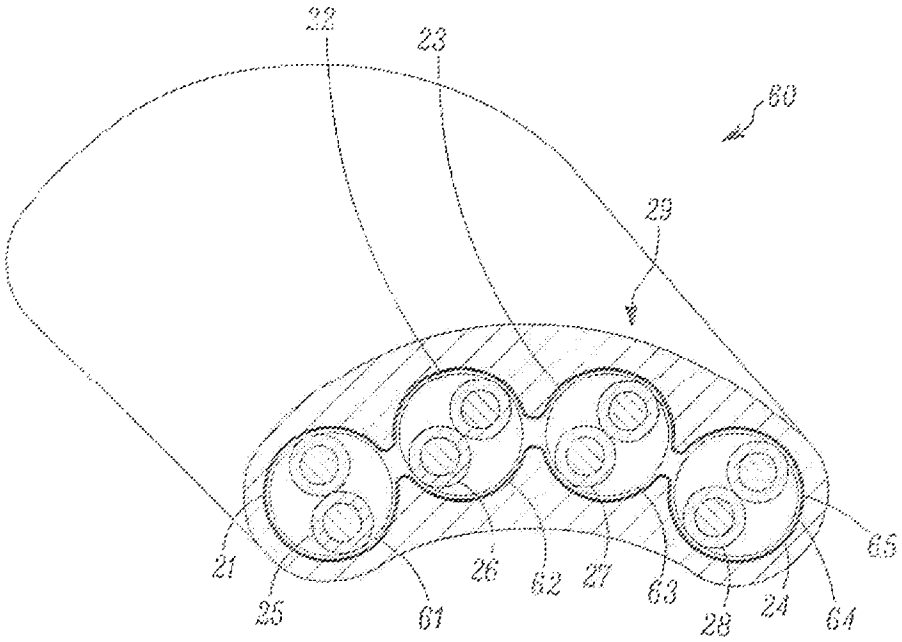
FIG. 6 is a side perspective view of yet another exemplary embodiment of the flat type cable shown in FIG. 2.

FIG. 6 illustrates a cable 60 utilizing the LSSL configuration, according to yet another embodiment of the present invention. The twisted pair conductors 25-28 are individually shielded by shields 61-64 and collectively shielded by a common shield 65. The metal used for the shields 61-64 and the common shield 65 may be as described in conjunction with FIG. 4 and FIG. 5.

Various embodiments of the LSSL configuration may be implemented in the form of a belted shielded flat type cable. The belted shielded flat type cables include a desired number of twisted pair conductors in the LSSL configuration, as per the requirements and application of the cable. The twisted pairs are jacketed in an inner jacket. A suitable shielding assembly is provided covering the inner jacket substantially completely. The shielding assembly may or may not include a drain wire. In various embodiments, the shielding assembly is bound by a spiral binder. This entire assembly including the twisted pair conductors, the inner jacket, the shielding assembly and the optional spiral binder or drain wire (if present) is then jacketed in an outer jacket. Embodiments of the belted shielded flat type cable are described below in conjunction with FIG. 7 and FIG. 8.

Figure 7:
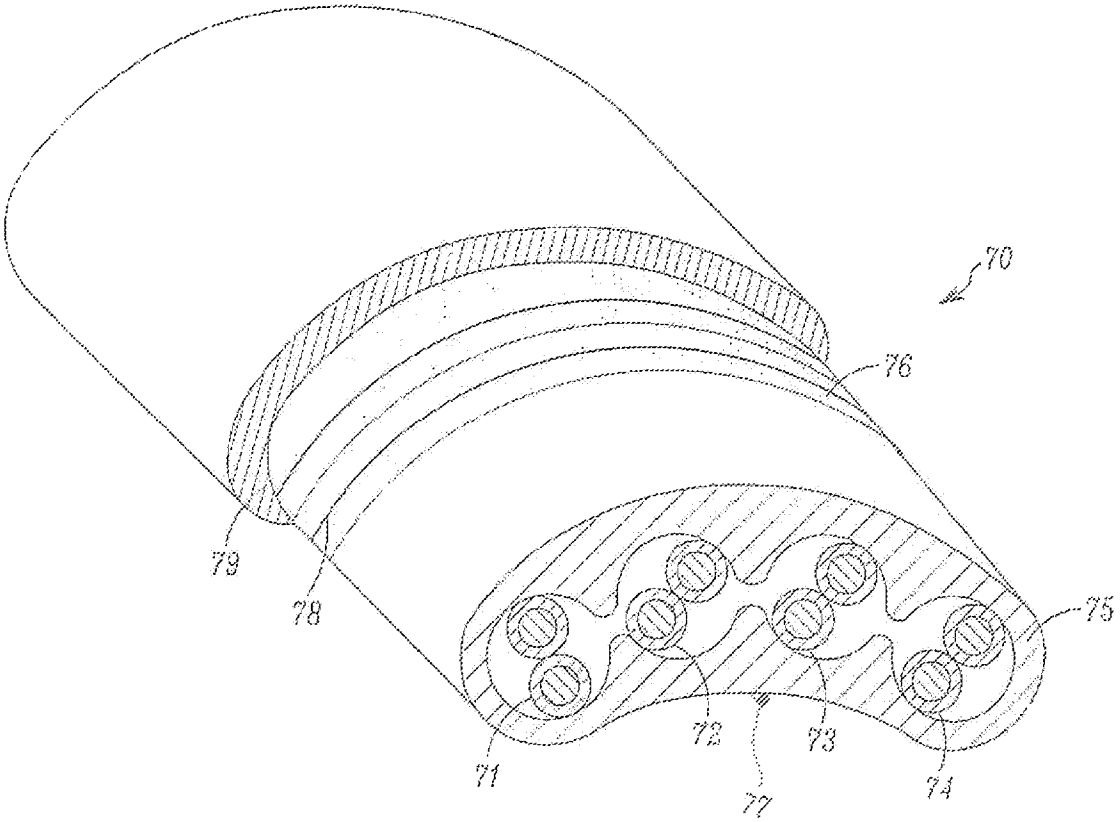
FIG. 7 illustrates a side perspective view of one exemplary embodiment of a belted and shielded flat type cable.

FIG. 7 illustrates a belted shielded flat type cable 70 in accordance with one embodiment of the present invention. The cable includes twisted pair conductors 71-74 in the LSSL configuration. The twisted pair conductors 71-74 are jacketed in inner jacket 75. The inner jacket 75 is surrounded by a shield 76. In various embodiments, the shield 76 may be in the form of a polymer backed metal foil, such as an aluminum-polyester foil. FIG. 7 illustrates the shield 76 disposed in a foil-in configuration, wherein the metal layer faces the inner jacket, and the polymer layer faces the outer jacket. A lateral drain wire 77 is disposed beneath the shield 76 in electrical contact with the metal layer of the shield 76. A spiral binder 78 is wound over the shield 76. In some embodiments, the spiral binder 78 may be a polyester fiber. This assembly including the twisted pair conductors 71-74, the inner jacket 75, the shield 76, the drain wire 77, and the spiral binder 78 are jacketed in an outer jacket 79.

Figure 8:
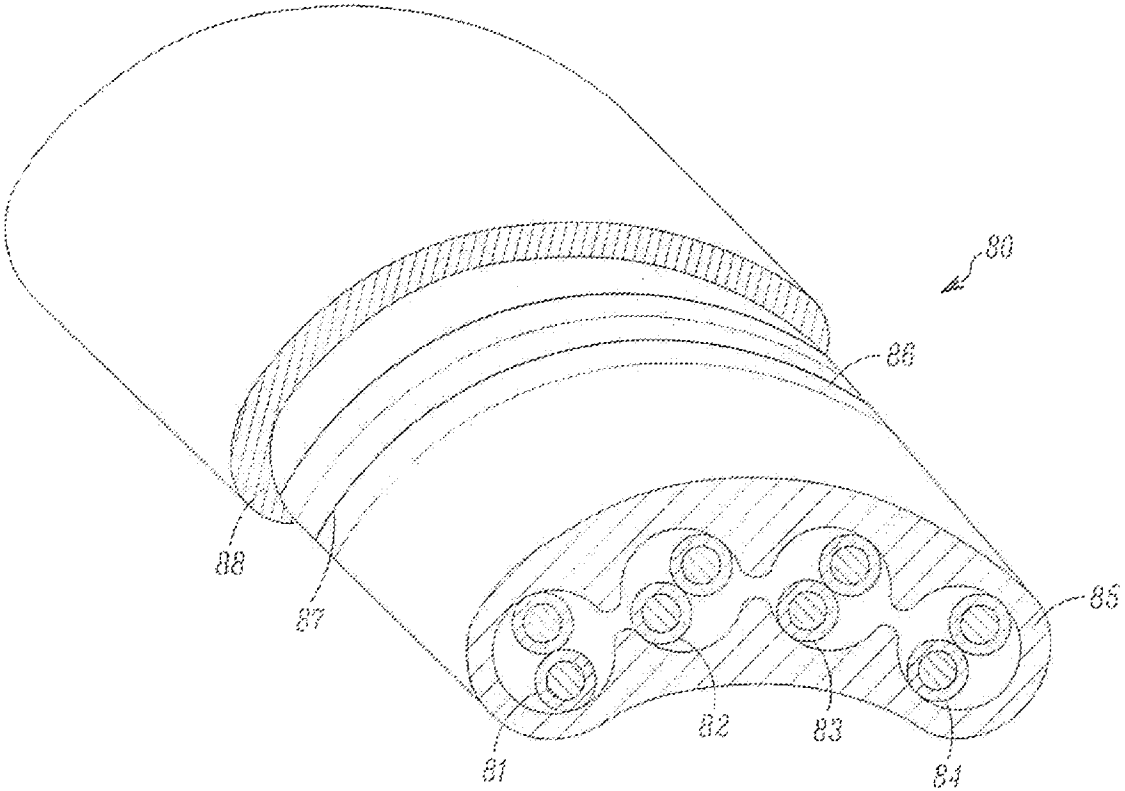
FIG. 8 illustrates a side perspective view of another exemplary embodiment of a belted and shielded flat type cable.

FIG. 8 illustrates a belted shielded flat type cable 80 in accordance with one embodiment of the present invention. The cable includes twisted pair conductors 81-84 in the LSSL configuration. The twisted pair conductors 81-84 are jacketed in inner jacket 85. The inner jacket 85 is surrounded by a shield 86. In various embodiments, the shield 86 may be in the form of a polymer backed metal foil, such as an aluminum-polyester foil. FIG. 8 illustrates the shield 86 disposed in a foil-out configuration, wherein the polymer layer faces the inner jacket, and the metal layer faces the outer jacket. A spiral drain wire 87 is wound over the shield 76 in electrical contact with the metal layer of the shield 86. The spiral drain wire 87 also functions as a spiral binder. This assembly including the twisted pair conductors 81-84, the inner jacket 85, the shield 86, and the spiral drain wire 87 are jacketed in an outer jacket 88.

Although FIG. 7 and FIG. 8 illustrate specific embodiments of the overall belted shielded flat type cable, a person skilled in the art will appreciate that any combination of the various components of the cable is possible, to obtain a desired flat type cable. In some embodiments, a foil-out shield may be employed with a lateral drain wire, with a polymer spiral binder binding the assembly together. In some other embodiments, the cable may include a floating shield, including no drain wire. The shield used may be in the form of a metal foil, or a braided metal shield. Further, the foil itself may be a continuous foil shield or a discontinuous foil shield. Various suitable metals such as aluminum, copper, silver, or alloys may be used for the shield as well as the drain wire, to achieve the desired cable performance and characteristics.

In various embodiments, the outer jacket may have a uniform thickness around its circumference. In other embodiments, the outer jacket may have greater thickness at the center than at the edges of the cable, thus contributing to the structural strength and or stiffness of the cable. The inner and outer jackets may be formed using a suitable foamed, unfoamed or partially foamed polymer such as polyvinyl chloride, ethylene-propylene-diene elastomer, thermoplastic fluoropolymer, neoprene, polyethylene, polyurethane, Teflon®, thermoplastic fluorocopolymer, and so forth.

Figure 9:
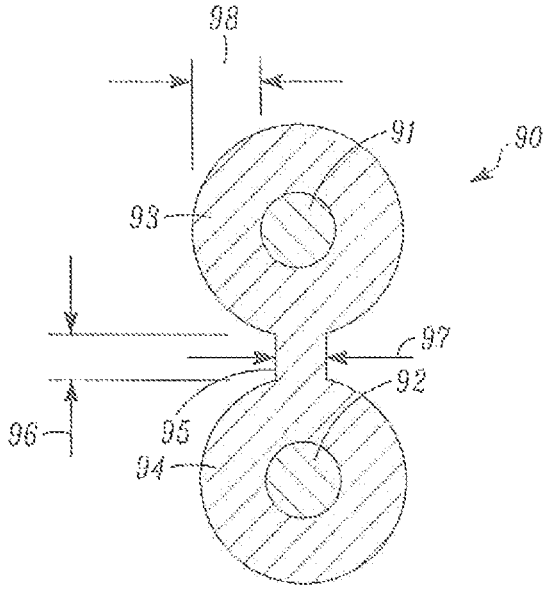
FIG. 9 is an enlarged cross-sectional view of a possible twisted pair conductor used in one embodiment of the present invention.
Figure 10:
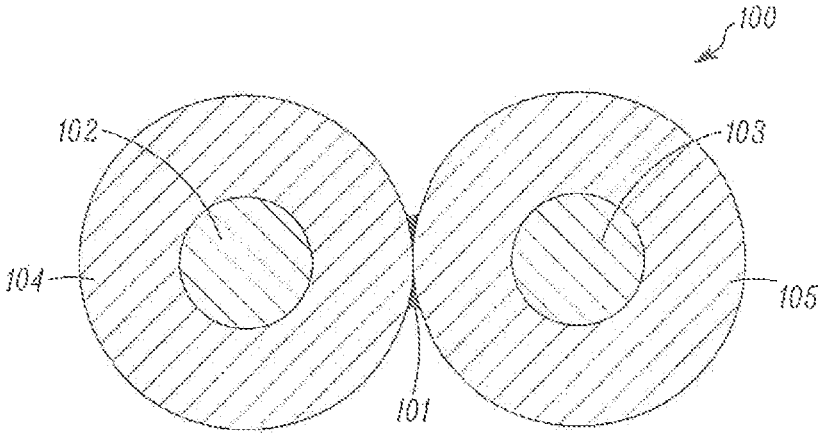
FIG. 10 is enlarged cross-sectional view of another twisted pair conductor used in another embodiment of the present invention.

Further, although FIG. 2 through 7 illustrate embodiments of four twisted pair conductor cables, the cable may include any number of twisted pair conductors, as per the requirements and the area of application of the cable. The twisted pairs in turn may contain two individual insulated conductors that are joined or separated and are twisted about each other. FIGS. 9 and 10, as hereinafter described, illustrate two exemplary embodiments of joined insulated conductor used to form a twisted pair conductor.

FIG. 9 shows a twisted pair conductor 90 that may be used in conjunction with various embodiments of the present invention. The twisted pair conductor 90 has two solid, stranded or hollow conductor wires 91 and 92. The conductors may be solid metal, a plurality of metal strands, an appropriate fiber glass conductor, a layered metal or combination thereof. Each conductor 91 and 92 may be surrounded by a respective cylindrical dielectric or insulation layer 93 and 94. Each of the conductors 91 and 92 is disposed centrally within and thus substantially concentric with the corresponding insulations 93 and 94. The conductors 91 and 92 may, if desired, adhere to any degree against the inner walls of the respective insulations 93 and 94 by any suitable means, such as, but not limited to, by bonding, by heat, by adhesives, or the like, to prevent relative rotation between the conductors and insulations.

The twisted pair conductor 90 has a common insulation for both conductors 91 and 92 as shown in FIG. 9 where the insulations 93 and 94 are integral with each other and are joined together along their lengths in any suitable manner. In an embodiment of the present invention, the joining means is a compression weld or any other methods known now or later discovered by those of ordinary skill in the art.

The diameter (traditionally expressed in AWG size) of each of the conductors 91 and 92 are preferably between about 18 to about 40 AWG, with 18-24 AWG typical.

The conductors 91 and 92 may be constructed of any suitable material, solid or strands, of copper, metal coated substrate, silver, aluminum, steel, alloys or a combination thereof. The dielectric may be of suitable material used in the insulation of cables such as, but not limited to, polyvinylchloride, polyethylene, polypropylene or fluoro-copolymers (such as TEFLON®, which is a registered trademark of DuPont), cross-linked polyethylene, rubber, etc. Many of the insulations may contain a flame retardant. A thickness 98 of the dielectric layer 96 and 97 may typically be in the range of from about 0.005 inches to about 0.025 inches.

One of ordinary skill in the art would understand that the embodiment which has just been described in conjunction with FIG. 9 has been given by way of illustration, and the invention is not limited to the precise embodiments described herein; various changes and modifications may be effected by one skilled in the art without departing from the scope or spirit of the invention.

FIG. 10 illustrates another twisted pair conductor 100 that may be used in conjunction with various embodiments of the present invention. The twisted pair conductor 100 is joined or bonded together substantially along their entire length by an appropriate adhesive 101. Material surface contact meniscus provides the adhesive volume. Instead of an adhesive, the adjacent dielectrics may be bonded together by causing material contact while the dielectrics are at elevated temperatures and then cooling to provide a joined cable having no adhesive.

The non-adhesive bonding may provide an integral common dielectric for the two conductors 102 and 103. The conductors 102 and 103 have an AWG size of from about 18 to about 40. The thickness of dielectric insulation coatings 104 or 105 is typically from about 0.005 to about 0.015 inches.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

What is claimed is:

1. A shielded flat-type cable comprising:

an inner flat-type jacket including at least three longitudinally extending and substantially parallel passageways not arranged about an axis located between them;

at least three twisted pair conductors, each of the twisted pair conductors being disposed inside one of the passageways, wherein at least one of the twisted pair conductors has a lay length different from another of the twisted pair conductors, and the twisted pair conductors which are disposed in the passageways located nearer to the edges of the inner flat-type jacket have a lay length greater than the twisted pair conductors which are disposed in the passageways located farther from the edges of the inner flat-type jacket;

a shielding assembly disposed covering the inner flat-type jacket; and an outer flat-type jacket covering the shielding assembly.

2. The shielded flat-type cable of claim 1, wherein the shielding assembly includes a drain wire.

3. The shielded flat-type cable of claim 1, wherein the shielding assembly includes a shield comprising a polymer-backed metal foil.

4. The shielded flat-type cable of claim 3, wherein the shield is an aluminum-polyester foil.

5. The shielded flat-type cable of claim 3, wherein the shield is disposed such that the polymer faces the outer flat-type jacket and the metal foil faces the inner flat-type jacket.

6. The shielded flat-type cable of claim 5, wherein the shielding assembly includes a drain wire disposed between the shield and the inner flat-type jacket and in electrical contact with the metal foil.

7. The shielded flat-type cable of claim 3, further comprising a spiral binder wound over the shield beneath the outer flat-type jacket.

8. The shielded flat-type cable of claim 3, wherein the shield is disposed such that the polymer faces the inner flat-type jacket and the metal foil faces the outer flat-type jacket.

9. The shielded flat-type cable of claim 8, further comprising a spiral drain wire wound around the shield between the shield and the outer flat-type jacket and in electrical contact with the metal foil.

10. The shielded flat-type cable of claim 3, wherein the metal foil is a continuous foil shield.

11. The shielded flat-type cable of claim 1, wherein the shielding assembly includes a braided metal shield.

12. The shielded flat-type cable of claim 1, wherein the cable is crescent shaped.

13. The shielded flat-type cable of claim 1, wherein each of the twisted pair conductors includes two individually insulated conductors that are joined together.

14. The shielded flat-type cable of claim 1, wherein at least one of the inner flat-type jacket and the outer flat-type jacket is made of a material including a foamed polymer.

15. A shielded flat-type cable comprising:

an inner flat-type jacket including a set of four longitudinally extending and substantially parallel passageways not arranged about an axis located between them;

a set of four twisted pair conductors, each disposed in one of the passageways, wherein two of the twisted pair conductors are of longer lay length than the remaining two of the twisted pair conductors, and the two twisted pair conductors of longer lay length are located in two of the passageways of the inner flat-type jacket that are furthest from each other;

an outer flat-type jacket surrounding the inner flat-type jacket; and a shielding assembly positioned between the inner flat-type jacket and the outer flat-type jacket.

16. The shielded flat-type cable of claim 15, wherein the shielding assembly includes a shield comprising a polymer-backed metal foil.

17. The shielded flat-type cable of claim 16, wherein the shielding assembly further comprises a drain wire in electrical contact with the metal foil.

18. The shielded flat-type cable of claim 15, wherein the shielding assembly comprises a braided metal shield.

19. The shielded flat-type cable of claim 15, further comprising a spiral binder wound around the shielding assembly and positioned between the shielding assembly and the outer flat-type jacket.

* * * * *